United States Patent [19]

Hiltner

[11] Patent Number: 4,708,070

[45] Date of Patent: Nov. 24, 1987

[54] LOOPER ASSEMBLY FOR A TWO THREAD BAG CLOSING SEWING MACHINE AND TWO THREAD LOOPING PROCESS FOR CLOSING BAGS

[75] Inventor: Andrew J. Hiltner, Minneapolis, Minn.

[73] Assignee: AXIA Incorporated, Oak Brook, Ill.

[21] Appl. No.: 812,786

[22] Filed: Dec. 23, 1985

Related U.S. Application Data

[63] Continuation of Ser. No. 542,190, Oct. 19, 1983, abandoned.

[51] Int. Cl.[4] ..... D05B 13/00; D05B 1/10; D05B 73/12

[52] U.S. Cl. ..... 112/10; 112/199; 112/254; 112/260; 112/262.1; 112/302

[58] Field of Search ..... 112/10, 11, 199, 254, 112/260, 262.1, 302, 324

[56] References Cited

U.S. PATENT DOCUMENTS

| | | | |
|---|---|---|---|
| 469,458 | 2/1892 | Weber | 112/199 |
| 1,041,652 | 10/1912 | Merritt | 112/260 X |
| 1,118,709 | 11/1914 | Weiss | 112/256 |
| 1,123,576 | 1/1915 | Onderdonk | 112/166 |
| 1,350,931 | 8/1920 | Moffatt et al. | 112/260 |
| 1,358,567 | 11/1920 | Moffatt et al. | 112/260 |
| 1,374,216 | 4/1921 | Moffatt | 112/200 |
| 1,748,052 | 2/1930 | Becker | 112/199 |
| 1,864,391 | 6/1932 | Zeier | 112/162 |
| 1,888,799 | 11/1932 | Grieb et al. | 112/256 |
| 2,029,242 | 1/1936 | Vesconte | 112/199 |
| 2,046,928 | 7/1936 | Riviere et al. | 112/199 |
| 2,172,321 | 9/1939 | Kucera | 112/200 |
| 2,199,666 | 5/1940 | Kucera | 112/215 |
| 2,312,858 | 3/1943 | Zeier | 112/199 |
| 2,446,306 | 8/1948 | Sauer | 112/256 |
| 2,494,901 | 1/1950 | Rubel | 112/162 |
| 2,778,328 | 1/1957 | Doyen | 112/11 |
| 2,879,733 | 3/1959 | Pierce | 112/256 |
| 2,960,946 | 11/1960 | Lutz et al. | 112/11 |
| 3,034,459 | 5/1962 | Shelley | 112/10 |
| 3,279,403 | 10/1966 | Jarrett | 112/256 |
| 3,418,955 | 12/1968 | Attwood et al. | 112/256 |
| 3,443,539 | 5/1969 | Scharmer | 112/169 |
| 3,478,709 | 11/1969 | Fishbein et al. | 112/11 X |
| 3,834,333 | 9/1974 | Seyama | 122/169 |
| 3,837,306 | 9/1974 | Doyel | 112/169 |
| 3,881,434 | 5/1975 | Kelly | 112/162 |
| 4,284,019 | 8/1981 | Marchesi | 112/256 |
| 4,344,376 | 8/1982 | Bhatia | 112/200 |
| 4,348,970 | 9/1982 | Robinson et al. | 112/256 |
| 4,362,113 | 12/1982 | Bock | 112/199 |
| 4,374,502 | 2/1983 | Toman | 112/162 |

FOREIGN PATENT DOCUMENTS

| | | | |
|---|---|---|---|
| 500071 | 11/1954 | Italy | 112/199 |
| 115221 | 5/1918 | United Kingdom . | |
| 1135830 | 12/1968 | United Kingdom . | |
| 1423390 | 2/1976 | United Kingdom . | |
| 2039549A | 8/1980 | United Kingdom . | |
| 2073263A | 10/1981 | United Kingdom . | |

*Primary Examiner*—Wm. Carter Reynolds
*Attorney, Agent, or Firm*—Conrad A. Hansen

[57] ABSTRACT

A looper assembly for a two thread bag closing sewing machine in a simple arc within a single plane on one side of a moving needle, the plane being parallel to the needle axis and intersecting the line of movement of the bags at an angle of less than 45 degrees to reduce thread wear and breakage. A process of stitching the bags utilizing looper movement within a single plane is also disclosed.

4 Claims, 22 Drawing Figures

LOOPER ASSEMBLY FOR A TWO THREAD BAG CLOSING SEWING MACHINE AND TWO THREAD LOOPING PROCESS FOR CLOSING BAGS

This is a continuation of application Ser. No. 542,190, filed 10/19/83, now abandoned.

BACKGROUND OF THE INVENTION

This invention relates to the field of two thread bag closing sewing machines and includes an improved looper assembly for two thread type machines and a process for two thread looping.

Two thread type sewing machines carry primary and secondary thread spools which supply the primary thread to the needle eye and secondary thread to a feed dog chamber located below the throat plate. This secondary thread is integrated with the primary thread during stitching to form the thread chain by interaction between a reciprocating needle and a looper assembly. In the known two thread bag closing sewing machines, the looper assembly utilizes a structurally complex thread carrying component which generally has a multiplicity of different and distinct mechanical movements. Typically the component is difficult and costly to form and follows a complex path including both swinging and thrusting movement in two or more intersecting planes on two or more sides of the needle. Because such structurally complex components and mechanical movements increase cost, require more operating space and increase the likelihood of failure and the frequencv of repair, it is highly desirable to provide a two thread looper assembly which is simple in configuration, easy to manufacture and utilizes simple, minimal mechanical movement within a single plane. None of the previously known two thread bag closing sewing machines utilizes a looper which moves along a simple arc within a single plane.

Still a further shortcoming of known two thread machines is that some utilize a looper which thrusts itself across the needle path at an angle of approximately ninety degrees to the direction of bag movement. This looper orientation can result in greater thread wear and breakage due to thread being first pulled normally in the direction of bag movement and then being sharply intercepted and pulled in a direction at right angles to the direction of bag flow.

While it is desirable to provide a simplified and improved two thread looper device which is usable with sewing machines of both the large stationary and the lightweight portable type, it is particularly crucial to have a streamlined, simple structure and movement for the looper of a two thread portable machine where weight and space are continually at a premium. The invention is particularly well adapted for use with portable bag closing machines of the general type shown in U.S. Pat. Nos. 3,094,955 and 4,348,970. These patents disclose a single thread portable bag closing sewing machine having a looper blade which moves in a single plane, but which is usable for single thread conventional stitching.

In recent years the need for two thread bag closing sewing machines has increased because of a growing need for double stitching of bags, and in some instances, specific government regulations requiring such stitching. The present invention provides an improved looper assembly which is simple in construction and moves along a simple arc wholly within a single plane on one side of the needle to eliminate the complex structure and movement associated with prior art two thread looping devices.

SUMMARY OF THE INVENTION

The invention comprises an improved looper assembly for a two thread sewing machine which is more economical, reliable and easily manufactured than presently available two thread looper devices.

The improved looper assembly embodying the invention utilizes a looper blade which swings through an arc within a single plane and passes on only a single side of the needle, utilizing only the described single swinging, reciprocating movement and avoiding the multiple plane, complex paths of prior art two thread loopers.

The improved looper cooperates with a throat plate which is provided with a thread retention notch communicating with a needle aperture passing through the plate. Loops of primary and secondary thread are formed by interaction between looper blade, notch and a spreader bar on the underside of the throat plate to orient the thread loops to intersect the needle path, thereby forming a consistently well knotted thread chain.

The looper blade utilizes an upright post, an elongated, cantileverly extending arm, and an eye at the free end of the arm. The intersection of post and arm defines a hook which catches and contains the primary thread loop during stitching.

Unlike prior art looper actions, the present invention utilizes a looper blade that moves in a plane which intersects the direction of bag movement at an angle of less than 45°, an angle between 10 and 20 degrees being preferred. By avoiding the right angle orientation of prior art loopers, thread wear and breakage can be reduced and the looper's reliability increased. By having the looper arm swing in a direction opposite to the direction of bag movement while inserting a secondary thread loop within the primary thread loop carried by the needle, bag momentum can be utilized to tighten the individual stitches.

A process of stitching a bag and embodying the planar movement of the looper is also disclosed.

These and other objects of the invention will become readily apparent as the following description is read in conjunction with the accompanying drawings wherein like reference numerals are used to refer to the views shown.

Figure 5:
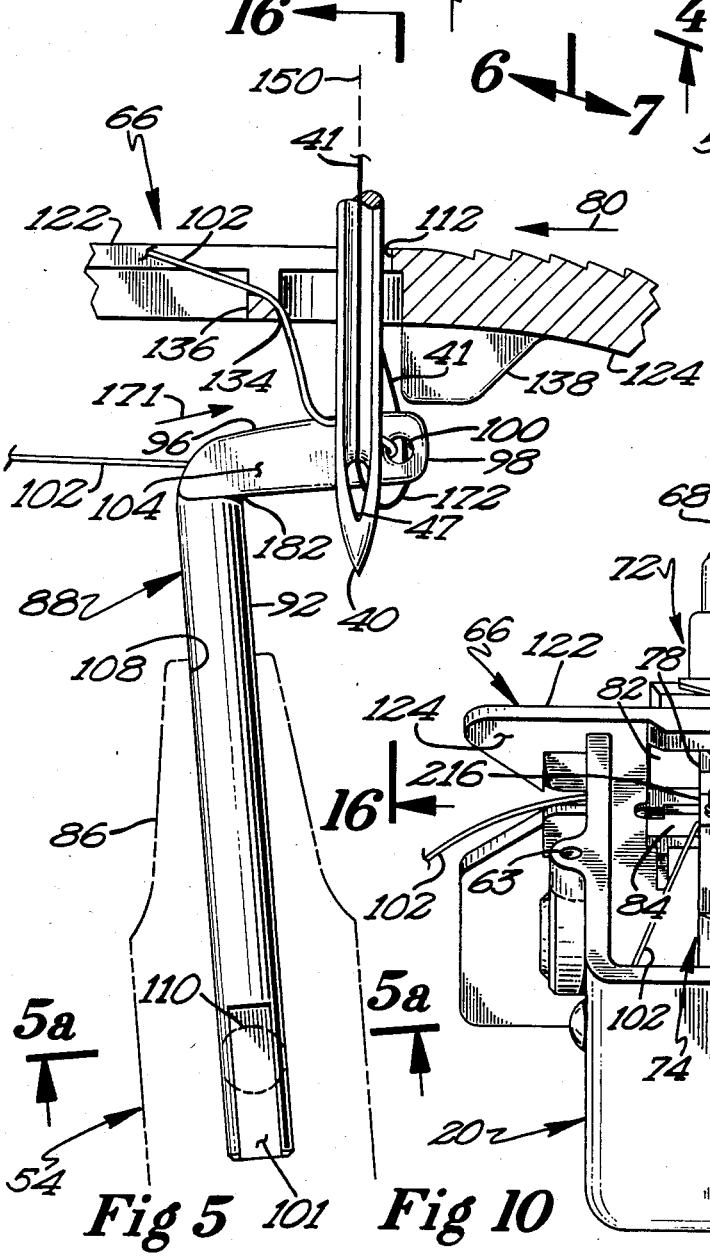
FIG. 5 is an enlarged bottom view showing the interaction between needle and looper blade of the machine of FIG. 1 during stitching of a bag.

**5*a* is a bottom, cross-sectional view of the looper and the needle taken in the direction of cutting plane 5*a*—5*a* of FIG. 5**.

Figure 3:
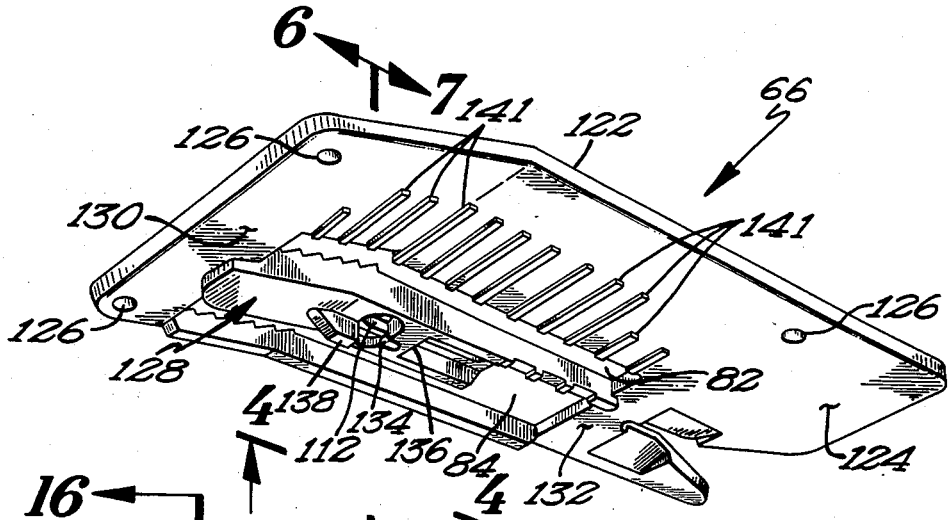
FIG. 3 is a perspective bottom view of the throat plate used with the machine of FIGS. 1 and 2.

FIG, 6 is a cross sectional view of a portion of the throat plate of FIG. 3 taken in the direction of cutting plane 6—6 of FIG. 3.

Figure 7:
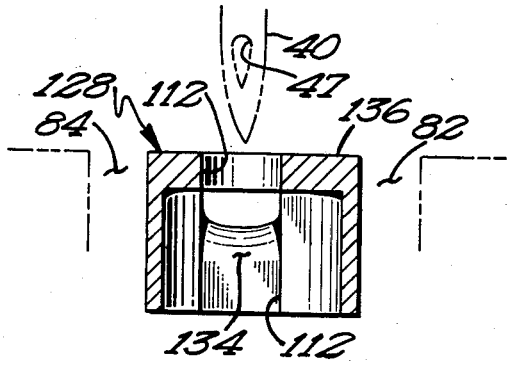
Figure 6:
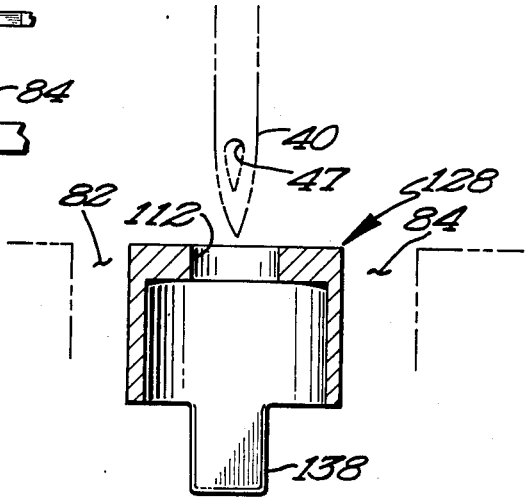

FIG. 7 is another cross sectional view of a portion of the throat plate of FIG. 3 taken in the direction of cutting plane 7—7 of FIG. 3.

Figure 1:
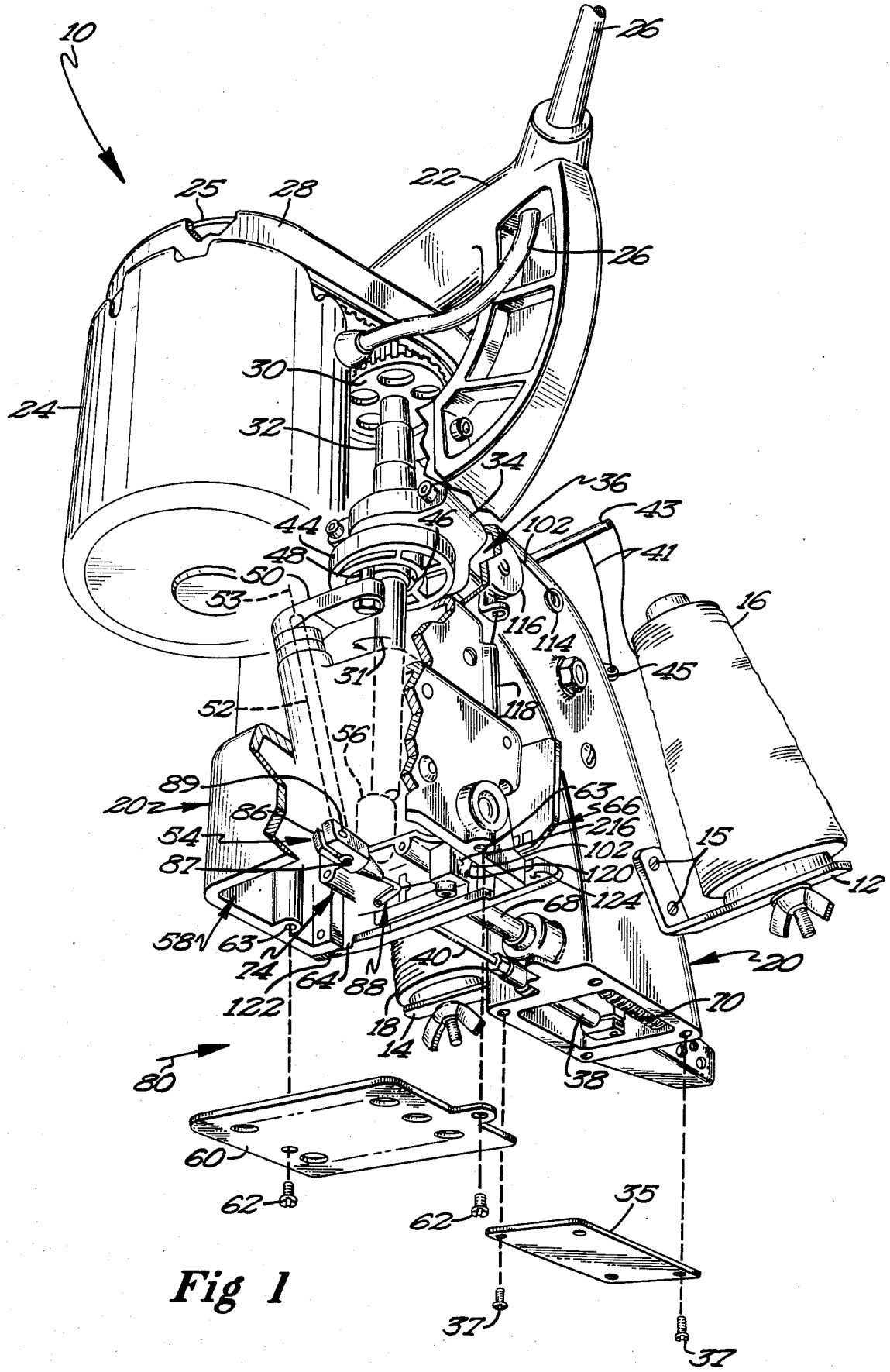
FIG. 1 is a perspective, partially cut away and exploded view of a two thread bag closing machine embodying the invention.
Figure 8:
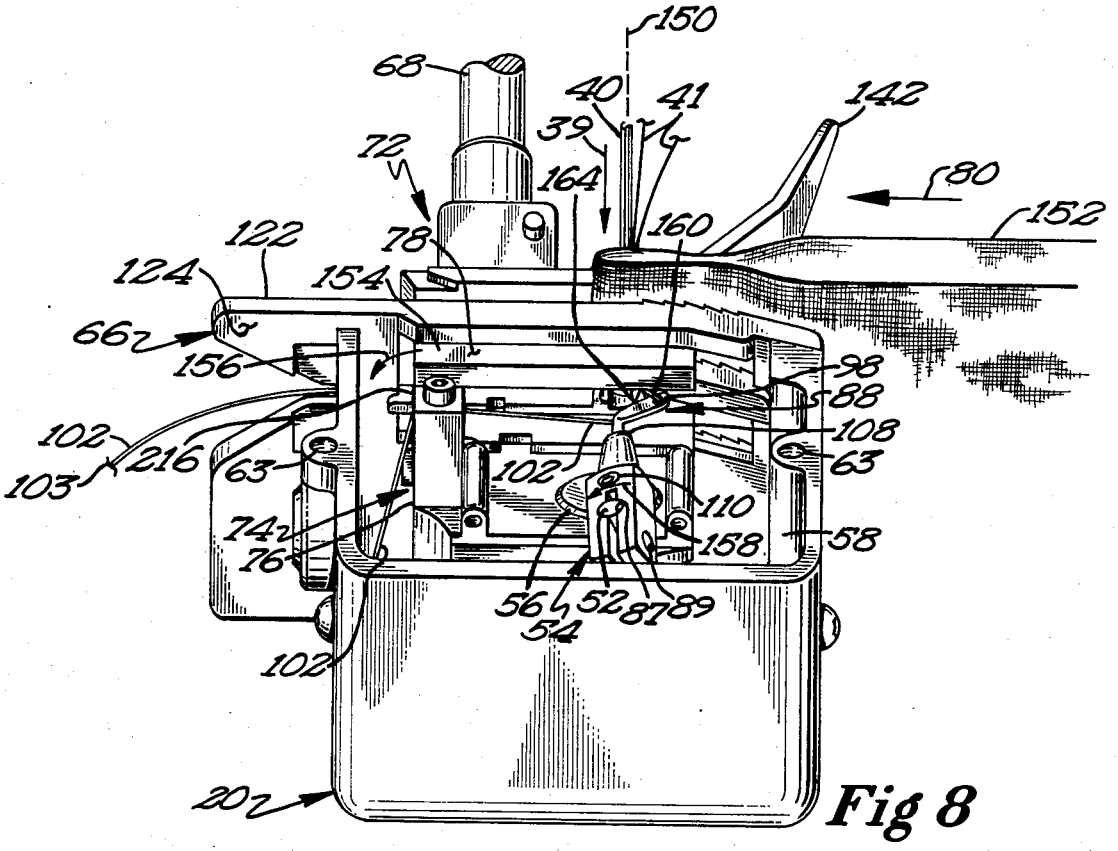

FIG. 8 is a perspective bottom view of the feed dog chamber of the machine of FIG. 1 and showing the machine components in another operational stage.

Figure 9:
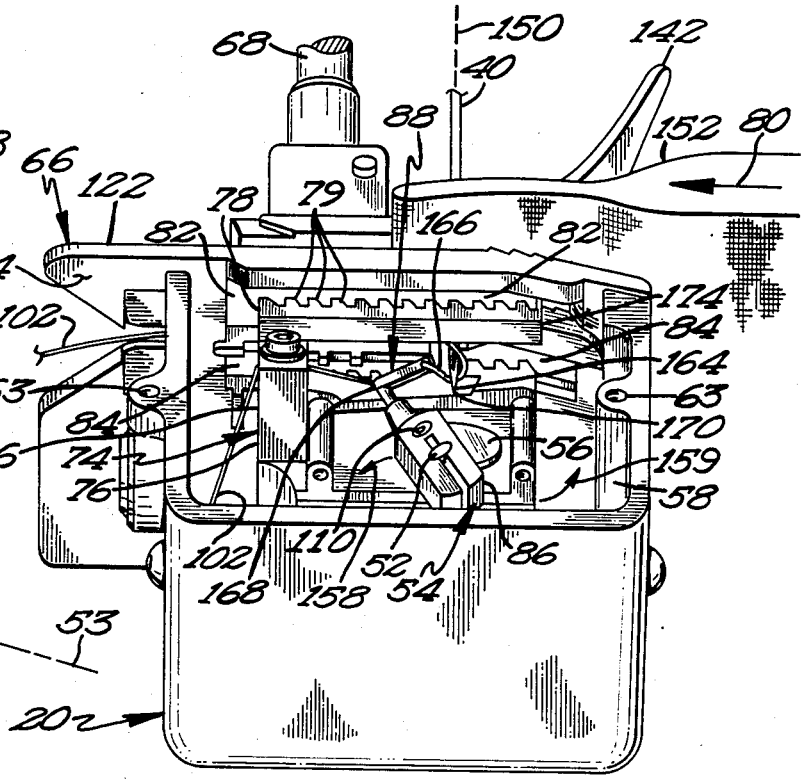

FIG. 9 is a perspective bottom view of the feed dog chamber of the machine of FIG. 1 and showing the machine components in a further operational stage.

Figure 10:
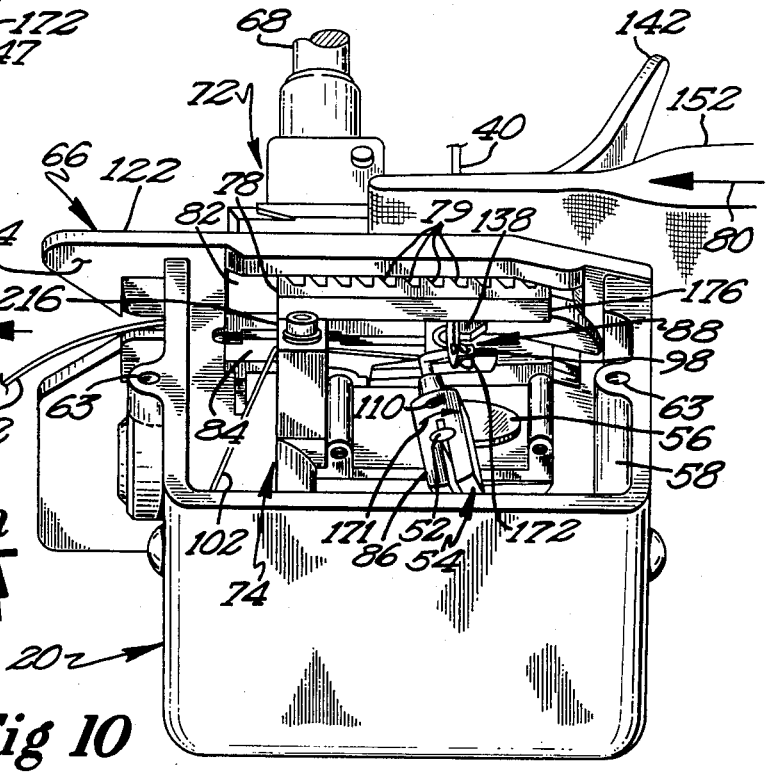

FIG. 10 is a perspective bottom view of the feed dog chamber of the machine of FIG. 1 and showing still a further operational stage of the machine components.

Figure 11:
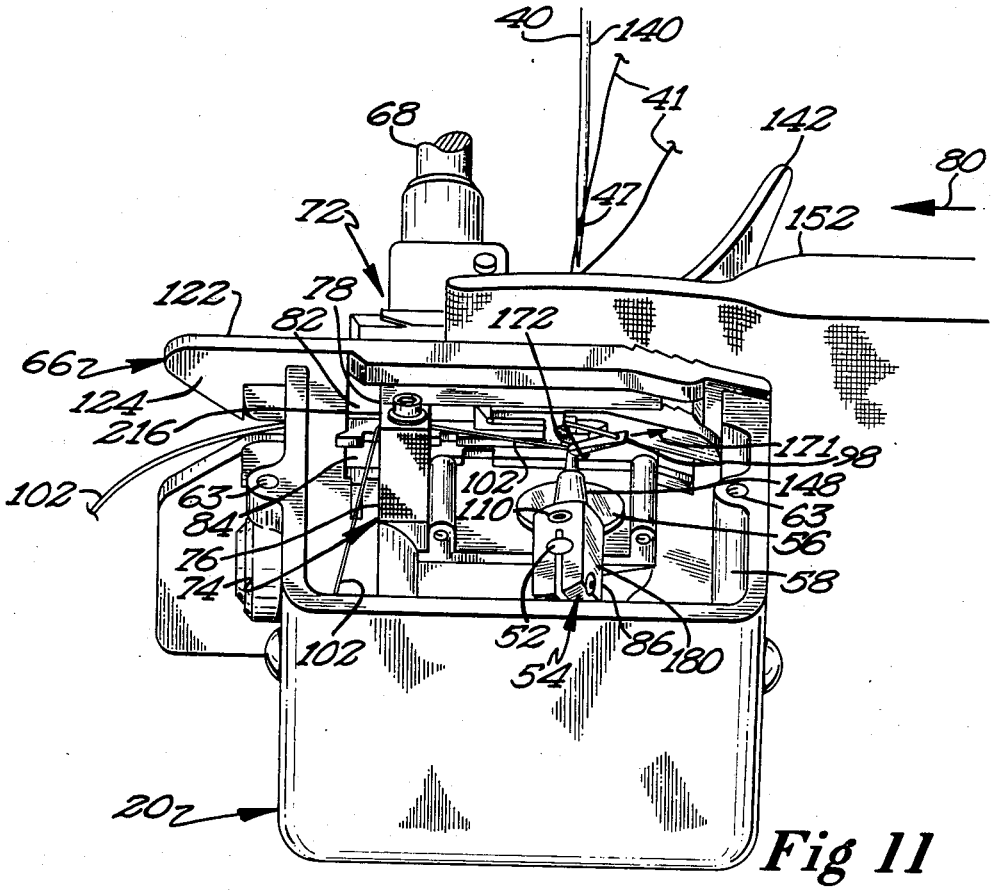

FIG. 11 is a perspective bottom view of the feed dog chamber and shows a further operational stage of the machine components.

Figure 12:
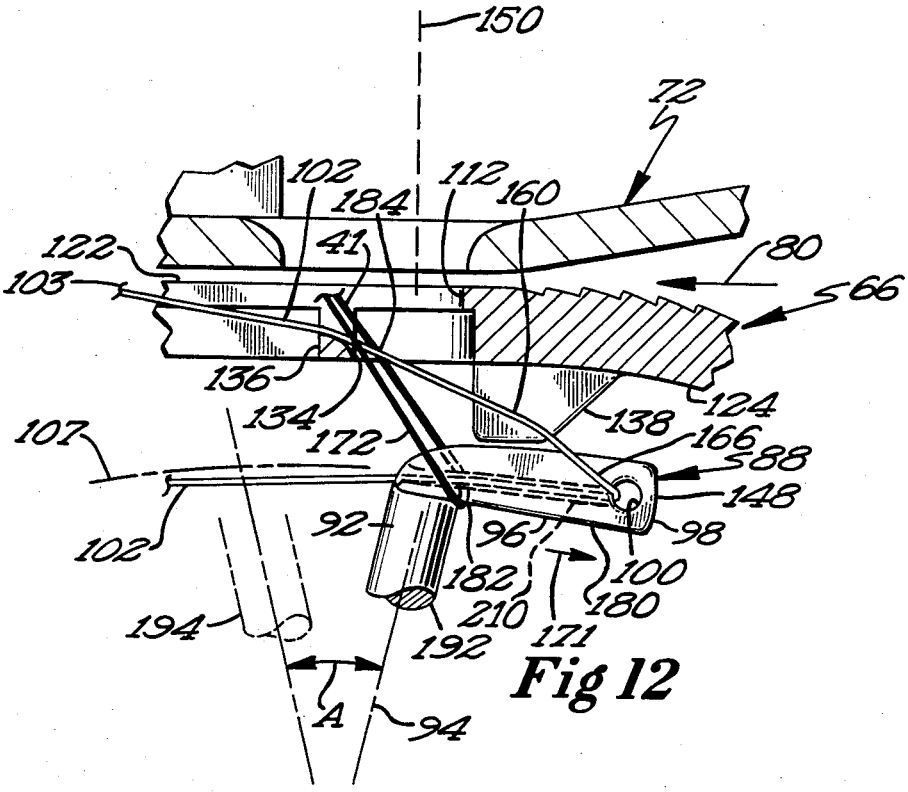

FIG. 12 is an enlarged bottom view of certain of the components of FIG. 11 showing the interaction between the looper blade, primary and secondary threads, and the throat plate.

Figure 13:
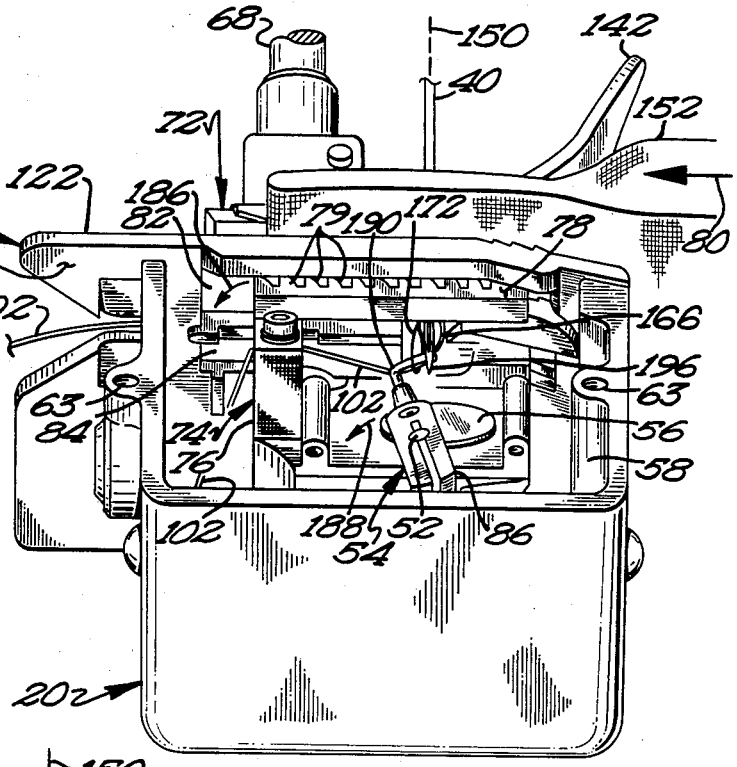

FIG. 13 is a perspective bottom view of the feed dog chamber of the machine of FIG. 1 showing an operational stage of the machine components.

Figure 14:
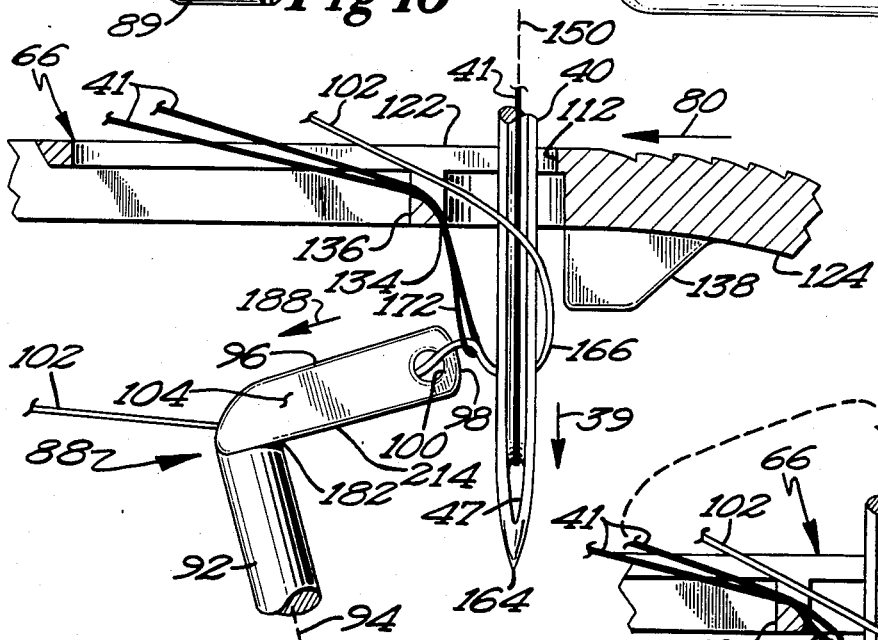
Figure 15:
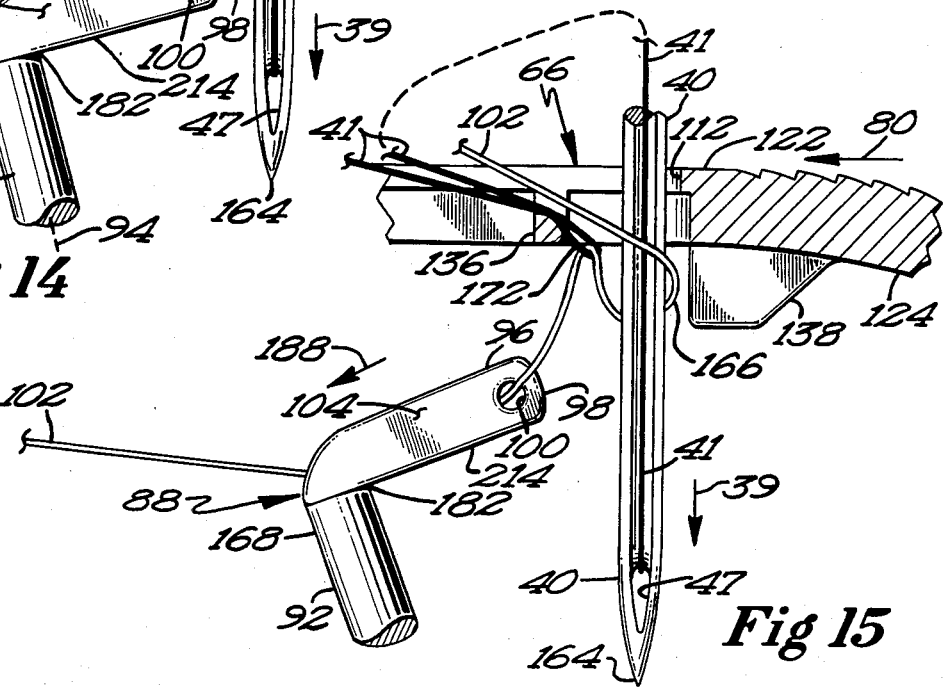

FIGS. 14 and 15 are enlarged bottom views of certain of the components within the feed dog chamber showing the interaction of the components during stitching during two successive stages.

Figure 16:
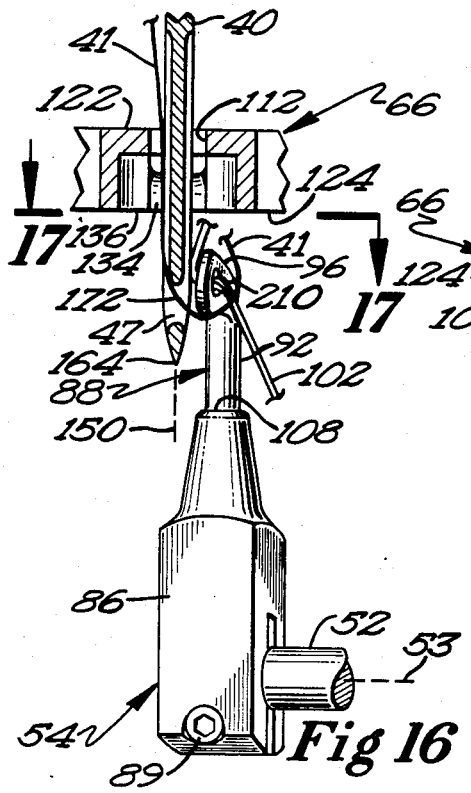

FIG. 16 is a side cross sectional view of the needle and looper block taken in the direction of cutting plane 16—16 of FIG. 5.

Figure 17:
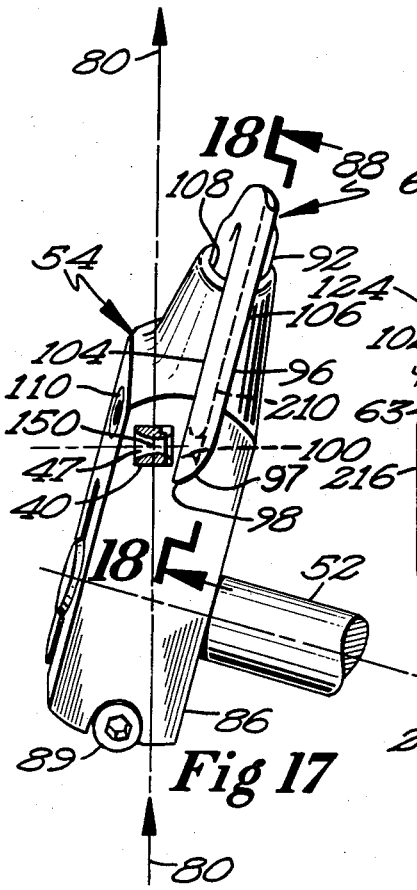

FIG. 17 is a side view of the looper block taken in the direction of cutting plane 17—17 of FIG. 16.

Figure 18:
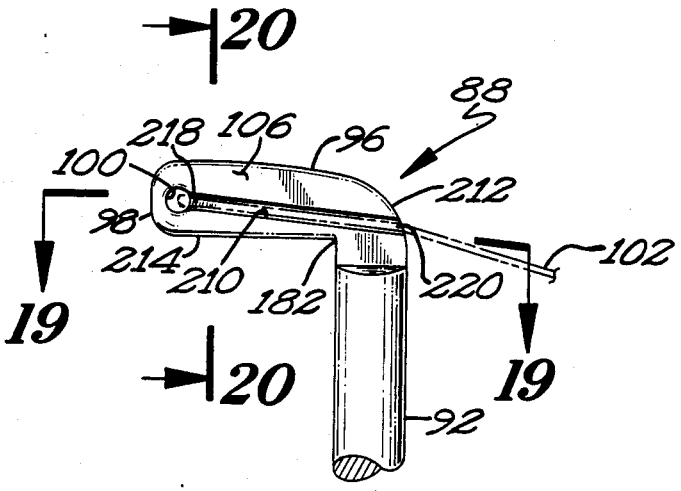

FIG. 18 is a partial top view of the end of the looper blade taken in the direction of cutting plane 18—18 of FIG. 17.

Figure 19:
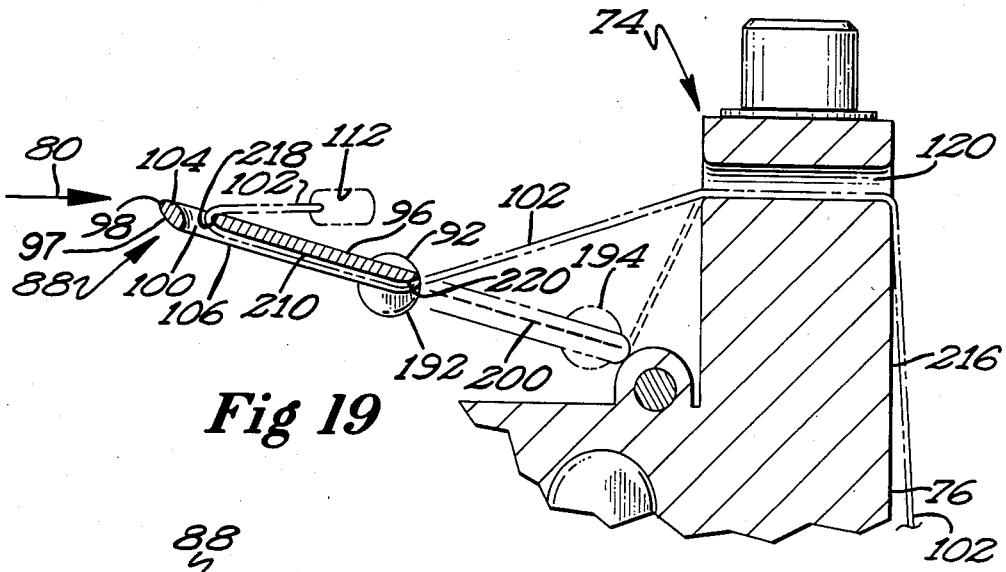

FIG. 19 is a top sectional view of the looper blade and feed dog block showing the path of the secondary thread and the extreme of the looper blade's positions during operation. FIG. 19 is taken in the direction of cutting plane 19—19 of FIG. 18.

Figure 20:
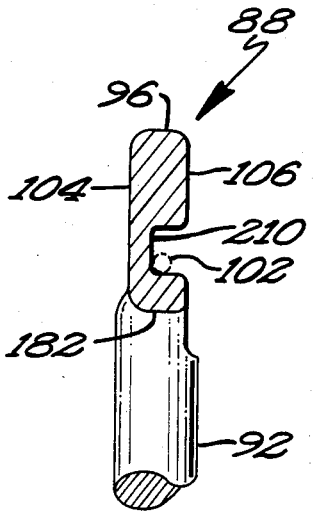

FIG. 20 is a side cross sectional view taken through the arm of the looper blade in the direction of cutting plane 20—20 of FIG. 18.

Figure 21:
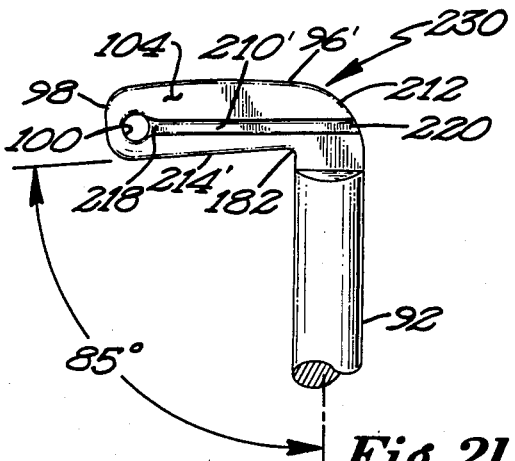

FIG. 21 is an alternative embodiment of a looper blade unsable with the invention.

DESCRIPTION OF THE PREFERRED EMBODIMENT

Referring now to FIG. 1, a portable two thread bag closing sewing machine 10 embodying the invention has a rigid protective housing 20 and carries spool mounting brackets 12 and 14 fixed to the machine 10 by screws 15 threaded into the housing, the brackets retaining spools 16 and 18 which comprise primary and secondary thread sources, respectively.

The bag closing machine 10 includes a carrying handle 22 and motor 24 attached to the housing 20, the motor being energized through a power cord 26 and a manually actuated switch (not shown) on the handle.

The electric motor 24 has a pulley 25 fixed to the upper end of its shaft, and a V-belt 28 encircles the motor pulley 25 and extends to a second pulley 30 which is fixed to the upper end of the main drive shaft 32 of the sewing machine. The main drive shaft 32 is rotatably mounted within the housing 20 in a generally vertical orientation. The motor 24, pulleys 25 and 30, belt 28 and rotatably mounted drive shaft 32 appropriately mounted to one another and to the housing collectively comprise a driving means usable with the invention to actuate the components of machine 10. While the specific driving means disclosed herein is preferred, it should be understood that other types of motors and drive trains may be substituted, if desired, and such alternatives are within the purview of the invention.

The shaft 32 carries a needle drive eccentric 34 which is connected to needle drive lever 36, the lever 36 being connected with other known parts which extend downwardly through the housing and reciprocate the needle drive shaft 38 in back and forth movement. The eccentric 34, lever 36, needle shaft 38, needle 40 and other known intermediate parts collectively comprise a needle driving assembly for moving needle 40 along a path 42 for piercing a bag during stitching. Because the structure of the shown needle driving assembly is well known to the art and fully disclosed in U.S. Pat. No. 4,348,970, it will not be described further. It should, however, be understood that the specific needle driving assembly described herein is merely illustrative of one type of needle driving assembly usable with the present invention, and that other mechanical arrangements suitable for driving the needle 40 in a reciprocating movement along the path 42 may be substituted and are within the purview of the invention.

Primary thread 41, originating at the spool 16, extends through guides 43 and 45, eventually reaching and passing through the eye 47 (FIG. 2) of the needle 40.

The lower end of the drive shaft 32 has an offset eccentric feed dog cam 56 which is rotatably journaled in a feed dog block 76 (FIGS. 2, 8 and 10), such that rotation of the drive shaft 32 in direction 31 moves the feed dog 78 in a substantially circular path centered on the shaft 32 to advance the bag in downstream direction 80 as will be described further hereafter.

Fixed to the drive shaft 32 is a looper cam 44 having an eccentric channel 46 formed in the lower surface thereof which engages a cam follower 48 which extends into and follows the channel 46 during rotation of cam 44. The followed 48 extends upwardly from a follower arm 50 which is fixed to a rotatably mounted looper drive shaft 52 having a central longitudinal axis 53.

The looper shaft 52 extends downwardly at an angle of approximately 14½ degrees from the vertical through bearings which are not shown in the drawing for purposes of simplification, and at its lower end carries a looper unit 54 which will be described further below. As main drive shaft 32 rotates about its central axis in direction 31, the looper cam 44 turns therewith and causes the follower arm 50 to swing reciprocatingly through an arc of approximately 28 degrees to swing the looper shaft 52 and actuate the looper unit 54. Looper cam 44, cam follower 48, arm 50, rotably mounted looper shaft 52 and looper unit 54 collectively comprise the looper assembly. The looper assembly and the needle 40 collectively comprise moving means for manipulating loops of secondary thread.

Figure 2:
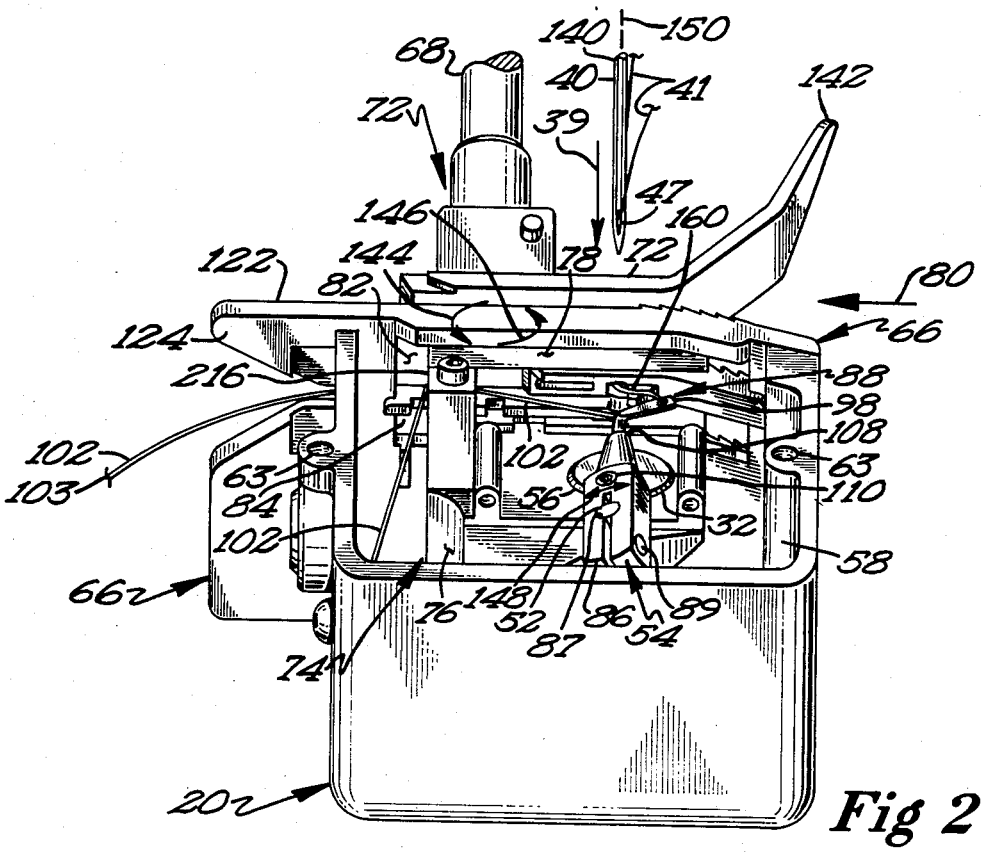
FIG. 2 is a perspective bottom view of the feed dog chamber of the machine shown in FIG. 1 and showing the machine components in initial positions.

Referring next to FIG. 2, the housing 20 includes a feed dog chamber 58 into which the looper drive shaft 52 and the main drive shaft 32 extend, and in which the looping action of the sewing machine occurs. The open bottom of the feed dog chamber 58 is closed during operation by detachable cover plate 60 which is secured by screws 62 threaded into bores 63 in the chamber wall. The feed dog chamber has an opening 64 in its sidewall which is covered by a generally flat, slightly angled throat plate 66, which has an important cooperative interaction with the looper unit 54 as will be discussed further hereafter. A third coverplate 35 is attached to the housing above the needle shift 38 by screws 37.

A conventional, well known presser foot assembly is mounted in the housing and includes a shaft 68 which is urged toward throat plate 66 by a spring 70 and carries presser foot 72 (FIG. 2) which bears against a passing bag and cooperates with the feed dog 78 to engage the bag therebetween during stitching.

Referring now to FIGS. 1 and 2, a feed dog assembly 74, usable with the invention, is rotatably mounted within the feed dog chamber 58 for rotation in a small, circular path centered on the central longitudinal axis of shaft 32, such rotation being in response to rotation of eccentric feed dog cam 56 which is rotatably received in a bearing aperture in the feed dog block 76. The feed dog 78 has teeth 79 (FIG. 9) extending outwardly from the feed dog chamber through slots 82 and 84 of throat plate 66. While a plurality of slide rods are used with the feed dog block to guide it during its circular motion, such guide rods are known to the art but omitted from the drawings in order to simplify the views and to facilitate better visibility of the looper assembly described hereafter. The feed dog assembly 74 includes the block 76, the attached feed dog 78 which cooperates with the presser foot 72 and the associated slide rods which carry the feed dog and support it within chamber 58. A more detailed description of the feed dog assembly is contained in U.S. Pat. No. 4,348,970. While the shown feed dog assembly is preferred for use with the present invention, other alternative appropriate feed dog assemblies may be substituted and are within the purview of the invention.

Referring now to FIGS. 1, 2 and 12, the lower end of looper drive shaft 52 carries looper unit 54 which comprises a looper block 86 and a removable, replacable integral, combined loop hooking and thread inserting looper blade 88. The block 86 is bifurcated and has a socket 87 which receives looper shaft 52. An Allen screw 89 tightens the bifurcations about the shaft 52 to lock the block firmly on the shaft in a predetermined angular orientation.

Figure 5A:
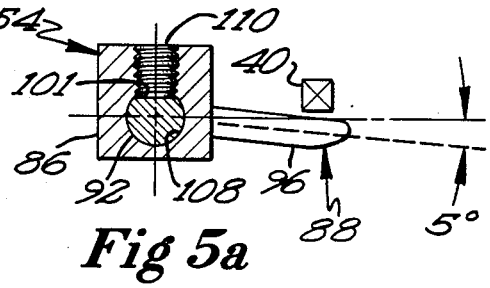

The looper blade 88, as best shown in FIGS. 5, 12 and 18–20 comprises an upright, straight, rigid post 92 having a central axis 94 and an elongated, cantileverly extending thin, straight arm 96 which extends outwardly at a riqht angle to post 92. The post axis 94 and the intersecting thin arm 96 define a plane which is oriented substantially perpendicular to shaft 52. Adjacent the free end 98 of the arm is a looper eye 100 which carries a loop of secondarv thread 102. The obverse and reverse faces 104 and 106, respectively, of the blade arm 96 are substantially flat with a beveled edge 97 at the end 98 to better facilitate the passage of the blade's arm 96 closely adjacent needle 40 as the bladē moves along blade path 107. The length of the arm 96, as measured from its intersection with post 92, has been found most effective if approximately equal to four times the diameter of the needle 40. The arm can be slightly longer, however, and still be effective. The arm 96 and post 92 define a hook 182 at their intersection for engaging the primary thread loop 172 during the looping operation. As shaft 52 swings through the arc A, the post 92 and looper blade 88 swing through the arc A of approximately 28 degrees between positions 192 and 194 (FIGS. 12 and 19) as they move along blade path 107. The path 107 which the blade 88 follows is an arc which passes closely adjacent the path 150 of the needle. It should be noted that the looper blade moves within a plane 200 (FIG. 19) which is defined by the locus of points along the path 107 of the looper eye 100 as best shown in FIG. 12. This plane is closely adjacent the needle path 150 and is stationary relative to the needle path and parallel to the path 150. The lower end of post 92 is provided with a flat surface 101 and is received in a socket 108 at the upper end of looper block 86, the post being securely retained in socket 108 by Allen screw 110 bearing against surface 101. As best shown in FIG. 5A the flat surface 101 is oriented five degrees off the angle at which arm 96 leaves the post 92 to thereby assist tne positioning of the post in the socket 108 so that the arm 96 closely approaches the needle 40. The arm 96 has a thread slot 210 extending from eye 100 to the end 212 of the arm to receive secondary thread 102, as will be described further hereafter. The slot 210 of blade 88 is angled at five degrees to the lower edge 214 of the arm to more readily align the thread 102 with a tunnel 120 in the feed dog block.

The secondary thread 102 which is carried by the looper eye 100 originates from secondary thread spool 18 and has its free end 103 extending outwardly from the feed dog chamber through needle aperture 112 of throat plate 66. To reach the feed dog chamber 58, the secondary thread extends from the spool 18, passing through the housing 20 along guideway 114 (FIG. 1). Thread 102 leaves the guideway 114 to thereafter encircle thread guide 116 after which it extends through channel 118 into the feed dog chamber 58. As best shown in FIGS. 2 and 19, the secondary thread 102, after entering the feed dog chamber 58, passes through a tunnel 120 in the feed dog block and emerges to thereafter extend to thread slot 210 and through the looper eye 100 of blade 88. The tunnel 120 is formed and oriented in forwardly extending section 216 of the feed dog block such that the axis of the tunnel is generally aligned with the direction of elongated, cantilever arm 96 to thereby minimize friction and drag between the feed dog block and arm 96 during relative motion between feed dog and arm, but the tunnel 120 is positioned forwardly of the arm 96, as shown in FIG. 19, so that the drag imposed on thread 102 bv guide 116 biases the thread 102 into the thread slot 210 and retains it in the slot during stitching. As a result of the use of slot 210, the thread 102 which extends along arm 96 is constrained to be within the plane 200 in which the looper moves. The ends 218 and 220 of the slot 210 are rounded to diminish friction between slot and thread.

An alternative embodiment 230 of an integral, combined loop hooking and thread inserting looper blade usable with the invention is shown in FIG. 21. The blade 230 is identical to the blade 88 of the earlier figures except that the angle between post 92 and lower edge 214' of the arm 96' is 85° and that the thread slot 210' is angled five degrees from the edge 214'. It has been found that looper blades having angles between 80° and 100° between the post 92 and arm edge 214 function effectively with the machine 10, but best results are obtained when the angle is between 85° and 90°. Operation of blades 88 and 230 are substantially identical and will be described hereafter.

Figure 4:
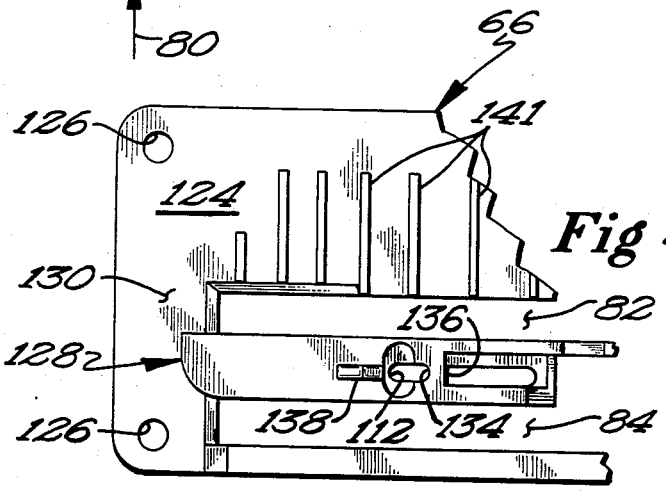
FIG. 4 is a bottom elevation view of a portion of the throat plate of FIG. 3 taken in the direction of cutting plane 4—4 of FIG. 3.

Referring now to FIGS. 3–5, the throat plate 66 has inner and outer surfaces 124 and 122, respectively, with screw holes 126 passing through the throat plate to receive screws (not shown) for securing it to the housing. The plate 66 has a pair of generally parallel elongated slots 82 and 84 which accommodate the teeth 79 of the feed dog 78 permitting the teeth to pass outwardly through the slots to bear against a bag and cooperate with the presser foot 72 to engage and move the bag past the needle. An elongated segment 128, integral with plate 66, is positioned between slots 82 and 84 and extends downstream from web 130 to web 132. The segment 128 has a needle aperture 112 passing between the surfaces 122 and 124 and through which the needle 40 moves during stitching. On the downstream side of aperture 112 is a thread retaining notch 134 which is formed in a crossbar 136 which extends transversely across segment 128. As will be described further hereafter, the thread retaining notch 134 cooperates with the blade 88 to position the secondary thread in a predetermined orientation suitable for stitching and looping. The lower surface 124 of the throat plate 66 is provided with a plurality of transversely extending reinforcement ribs 141 which strengthen the plate.

A ramp-like spreader bar 138 is positioned on the lower surface 124 of segment 128 upstream of the needle aperture 112 and extends outwardly from the surface 124, cooperating with the looper blade 88 to orient the secondary thread loop 178 to facilitate insertion of the downward moving needle 40 within the loop 178 of secondary thread as will be described hereafter.

In operation, the user of the sewing machine first threads the primary and secondary threads 41 and 102 along appropriate guides to needle eye 47 and looper eye 100, respectively, passing the threads through the eyes. With the needle in the raised position 140 shown in FIG. 2, a bag is fed into the gap between throat plate 66 and the raised entry guide 142 of presser foot 72. For purposes of simplification, in the following description of machine operation, the primary thread 41 associated with the needle 40 is shown as wholly shaded and the secondary thread 102 associated with the looper unit 54 is shown unshaded.

In the starting configuration illustrated in FIG. 2, the feed dog 78 is substantially in its outermost position during which its teeth 79 project beyond the throat plate 66 with the teeth passing through the slots 82 and 84 so as to engage a bag and to urge it against the presser foot 72. In the outermost position of the feed dog teeth shown in FIG. 2, the teeth of the feed dog will force the presser foot 72 away from the throat plate 66 a distance of approximately a sixteenth inch or more. In response to rotation of main drive shaft 32, the feed dog 78 moves in a generally circular path in a counter clockwise direction as viewed from the bottom of the machine looking upward along the axis of drive shaft 32. During the movement of the feed dog along its path, it will advance the bag through the machine in direction 80 and subsequently swing downwardly in direction 144 into the feed dog chamber 58, after which it will move upwardly in direction 146 to advance the bag for the next stitch.

When the needle 40 is in its raised position 140 (FIG. 2) prior to bag entry, the looper unit 54 is in position 148 wherein the looper blade 88 is oriented with its free end or tip 98 positioned fully to the right as viewed in FIG. 2.

To start the machine, the operator depresses the push button switch carried by handle 22 (FIG. 1) and the motor 24 begins rotating pulley 26 to transmit rotational movement through belt 28 to the main drive shaft 32. Rotation of shaft 32 in direction 31 actuates the various subparts of the machine including the needle driving assembly 36, causing the needle 40 to move downwardly from position 140 (FIGS. 2 and 5) along a clearly defined straight line path 150 along the axis of the needle.

As main drive shaft 32 rotates, it carries the attached looper cam 44 (FIG. 1) therewith, causing the looper follower arm 50 to reciprocate through an arc of approximately 28° as the arm follows the channel 46. This movement repeatedly swings the looper unit 54 through an equivalent which will be further described below. Rotation of the main drive shaft 32 also rotates the integral feed dog cam 56, actuating the feed dog block through its circular path to advance a bag through the machine 10.

In the following operational description involving the drawing FIGS. 2–16, the movement of the various machine components will be described as being upward, downward, leftward and rightward. These terms are used with respect to the orientation of the components shown in the drawing figures. It should be understood, however, that when the machine 10 is in commercial operation, it is likely to be operated in the orientation shown in FIG. 1. Accordingly, in most views of the drawings, the described directional conventions represent directions as viewed by an observer looking generally upwardly into the feed dog chamber 58 of FIG. 1.

Referring now to FIG. 8, as a bag 152 moves in downstream direction 80 to enter the machine 10, the bag is gripped by the feed dog 78 which advances the bag a predetermined distance in direction 80 past the needle 40. Having reached the full left position 154, the feed dog, as shown in FIG. 8, will swing downwardly in direction 156, and needle 40 will move dowwardly in directon 39, piercing the bag 152 and passing through needle aperture 112 of the throat plate to enter the feed dog chamber 58, and carrying the primary thread 41 with it.

During the downward descent of needle 40 from raised starting position 140 (FIG. 2), looper unit 54 swings leftwardly in direction 158 to the position shown in FIG. 8. As the looper moves from the starting position shown in FIG. 2 to that of FIG. 8, the secondary thread 102 includes a thread segment 160 (best seen in FIG. 12) which is part of secondary thread loop 166 and extends between the looper eye 100 and the thread retention notch 134, the upper end of secondary thread 102 being clamped between presser foot 72 and throat plate 66. As the looper unit 54 swings leftwardly from the position of FIG. 2 to the position shown in FIG. 8, the short part of secondary thread segment 160 between retention notch 134 and looper eye 100 is slackened slightly, so as to cause it to be urged outwardly toward the reader as viewed in FIGS. 8 and 12. This outward movement results in the thread segment 160 being just clear of needle path 150, as shown in FIG. 8, to allow the tip 164 of needle 40 to begin passing within segment 160 as the needle moves in downward direction 39. During downward movement of the needle through the bag 152, the feed dog 78 is disengaged from the bag and does not move the bag.

Referring next to FIG. 9, the needle 40 continues its descent with the tip 164 passing further through the secondary loop 166. As the needle moves downward through the loop 166 to its full down position 170, the looper unit 54 continues swinging leftwardly in direction 158 about the axis of the looper shaft 52. As the looper blade 88 moves leftward as shown in FIG. 9, the secondary thread 102 slides along thread slot 210 and through the looper eye, being supplied from the tunnel 120 which passes through section 216 of the feed dog. With the needle 40 in its full downward position 170, the feed dog 78 has its jaws 79 in a position 174 well below the upper surface of the throat plate 66 and is moving to the right and upwardly in direction 159 on its way to a position where the jaws 79 can eventually engage the bag 152 and move it in direction 80 for the next needle stitch. In FIG. 9, the looper is shown at its most full left displacement 168 and will next be swinging to the right toward the needle 40.

During the operation of the machine 10, secondary thread is delivered to the looper blade 88 from the tunnel 120 in the feed dog section 216. As best shown in FIG. 19, the secondary thread 102 angles sharply as it leaves the tunnel 120 and heads toward the blade 88. This distinct angling biases the thread 102 into the thread slot 210 so as to closely confine the secondary thread and direct it to the looper eye 100, keeping the thread substantially within the plane 200. The swinging movement of the looper between positions 192 and 194 as well as the moving feed dog block 76 exert a pulling motion on the secondary thread 102 to overcome the drag established by the intermediate guide means 43 and 116. This combination results in a close cooperation between the guides, which provide enough drag to keep the thread 102 biased against the well of the thread slot 110, and the inherent movements of the blade 88 and the block 76, which smoothly overcome the drag and assist the thread 102 to move toward the looper eye 100. Such cooperation reduces the likelihood of breakage and frictional wear of the thread as the thread 102 is pulled through the machine by primary interaction between the feed dog teeth 79 and the bag 152.

Referring next to FIGS. 5 and 10, the looper unit has swung further to the right in direction 171, moving toward and passing the needle 40. As the blade tip 98 closes in on the needle, the needle moves upwardly, thereby causing the loop 172 of primary thread to spread laterally rearwardly from the needle and allowing the tip 98 of the looper blade 88 to easily enter the spread out primary loop 172 as the blade passes rearward of the needle and moves further to the right of the needle as viewed in FIGS. 5 and 10. As the looper unit 54 is swinging through the primary thread loop 172, the feed dog 78 has moved from position 174 to its most rightward position 176 and is moving upward toward the throat plate 66.

Referring next to FIGS. 11 and 12, the looper unit 54 is shown as having swung to the right in direction 171 to its original full right position 148. During such movement, the tip 98 of the looper blade 88 has moved wholly through the primary loop 172 and inserted the secohdary loop 166 through the primary loop 172. During movement of the looper blade 88 to its extreme right position 148, the primary loop 172 has been pulled leftward in direction 80 into the hook 182. The primary thread loop 172 is pulled to its position in the hook 182 by movement of the feed dog 78 which engages the bag 152 and moves the bag, to which primary thread 41 is attached, in direction 80. During the time interval in which the primary and secondary loops 172 and 166, respectively, are in the orientation shown in FIG. 12, the primary loop 172 closely confines the thread segment 160 at point 184 and retains the segment 160 as the segment 160 is urged against the side of spreader bar 138. The clearance created between looper blade 88 and thread segment 160, due to interaction between the looper eye 100 of the arm 96, spreader bar 138 and the tensioning effect of tightened primary loop 172, collectively assure adequate clearance for the needle 40 to pass between secondary segment 160 and arm 96 as the looper blade begins to swing leftward as will be described in conjunction with FIGS. 13 and 14.

Referring again to FIG. 12, thread retention notch 134 receives the secondary thread 102 and the primary thread loop 172 into the notch 134 as the feed dog moves the bag in direction 80, thereby assuring that the primary loop 172 is kept clear of the needle path 150 during downward needle movement and that the secondary thread 102 remains in the configuration shown in FIG. 12 as the needle 40 moves downward through the loop 166.

All necessary secondary thread 102 required by the looper blade 88 is obtained from the thread spool 18 by the looper movement pulling the thread 102 through various guides and out of the tunnel 120 in the feed dog block. By having the looper blade 88 moving in a direction in near alignment to the axis of the tunnel 120 and by having the looper blade path generally aligned with the direction of bag movement 80, the thread 102 can be smoothly drawn out by the looper with minimal frictional wear or breakage of the secondary thread. Such movement of the looper along a path 107 (FIG. 12) such that the plane 200 defined by the path of the central axis of the post 92 (FIG. 19) intersects the direction of bag movement 80 at an angle not exceeding 45 degrees, greatly reduces the wear and breakage of secondary thread as compared with loopers which move at right angles to the direction of bag flow. Still further, improvement is present when the angle does not exceed 20 degrees, and best results occur when the angle is between 10 and 20 degrees. The shown arrangement wherein the free end of the arm 96 swings in an upstream direction generally opposite the direction 80 during insertion of the secondary loop 120 also improves operation by utilizing bag momentum to tighten the forming stitches.

Referring again to FIGS. 11 and 12, as the looper unit 54 reaches the position 180, the needle 40 is substantially at its upper position 140, the looper unit 54 is at its rightmost limit, and the feed dog 78 has engaged the bag 152 and is moving in direction 80 to slide the bag a distance equal to the spacing between adjacent stitches in the bag.

Referring next to FIGS. 13 and 14, during continued operation the needle 40 moves downwardly toward the throat plate 66 while the feed dog 78 swings leftwardly and downwardly in direction 186 to disengage the feed dog jaws from the bag 152 prior to entry of the needle 40 into the bag. The needle 40 continues to descend, passing through the bag and the throat plate 66 downwardly to position 196 within the feed dog chamber 58 as shown in FIG. 13. As the needle tip 164 approaches the looper arm 96, the looper unit swings leftward in direction 188, thereby causing the secondary thread segment 166 to spread slightly laterally outwardly toward the reader as viewed in FIGS. 12 and 13 to provide additional clearance from the needle path 150 while the needle 40 passes downwardly between segment 166 and looper arm 96 to cause the secondary loop 166 to encircle the needle as shown in FIGS. 13 and 14.

As the looper blade moves in direction 188 to position 190 (FIG. 13), the primary loop 172 slips toward the end 98 of the looper blade and off the blade and onto the secondary thread loop 166 as shown in FIG. 14.

As the looper unit 54 continues to swing to the left in direction 188, it pulls and begins to tighten the secondary thread loop 166 as best shown in FIG. 15. Simultaneously with such tightening, the downward movement of needle 40 in direction 39 pulls primary thread 41, which extends to primary loop 172, to shorten and thus tighten the primary loop 172 about secondary thread 102 to aid in forming the stitch. After forming the stitch as shown in FIG. 15, the needle 40 moves upwardly while the looper unit 54 returns from its full left position 168 and swings into and engages the primary thread loop 172 as shown in FIGS. 5 and 10. The looper unit 54 then continues to swing to the right in direction 171 as shown in FIG. 12 with the needle 40 moving upward and clear of the bag and the primary thread loop 172 being urged into the hook 182. As the needle clears the bag, the feed dog 78 has re-positioned itself to engage the bag and to move it leftward for the next stitch. As the bag is moved in direction 80 by cooperation between feed dog 78 and presser foot 72, the bag movement further pulls the still tightening stitch 172 shown in FIG. 15 snugly up against the bottom of the bag 152.

The stitching process then continues as has been described in conjunction with the figures, continuing and repeating in steps described in FIGS. 13 to 15.

The alternative embodiment 230 of the looper blade shown in FIG. 21 may be substituted directly for the embodiment 88 shown in FIGS. 1–20. The operation of the two embodiments is identical.

While the preferred embodiments of the present invention have been described, it should be understood that various changes, adaptions and modifications may be made therein without departing from the spirit of the invention and the scope of the appended claims.

What is claimed is:

1. A two thread type bag closing sewing machine capable of stitching a bag closed as the bag moves in a downstream direction through said machine comprising:

a rigid housing including a feed dog chamber;

driving means carried by said housing;

primary and secondary thread sources adjacent said housing for supplying primary and secondary thread, respectively;

a needle driving assembly movably mounted to said housing, operatively connected with said driving means and including a reciprocating needle movable along a needle path into and out of said feed dog chamber, said needle including an eye, said eye carrying a loop of said primary thread;

a presser foot assembly adjacent said needle and carried by said housing to bear against the bag;

a feed dog assembly carried by said housing, operatively connected with said driving means and including a movable, reciprocating feed dog confronting the bag and cooperating with said presser foot assembly to advance the bag in said downstream direction past the reciprocating needle during stitching of the bag;

a throat plate adjacent said feed dog, said plate including a needle aperture communicating with said feed dog chamber and positioned along said needle path to receive said needle during stitching; and a looper assembly consisting of a single looper drive shaft, a looper cam connected with said driving means and a single looper unit fixed to said single looper drive shaft, said looper drive shaft being movably mounted to said housing, having a central axis and being operatively connected with said looper cam for reciprocal swinging of said shaft through an arc about said looper shaft central axis, and said single looper unit consisting of a single combined loop hooking and thread inserting looper blade, said blade having a post with a post axis, said blade having an eye carrying a loop of said secondary thread, said looper blade being swingable closely adjacent said needle path in response to swinging of said looper shaft in a first direction and away from said needle path in response to swinging of said looper shaft in a second direction with the locus of said post axis defining a single plane which is substantially stationary relative to said needle path during swinging of said looper shaft in both first and second directions, so said blade cooperates with said needle to hook said loop of said primary thread as said blade moves adjacent said needle and inserts said loop of secondary thread through said loop of primary thread.

2. The combination of claim 1 wherein said throat plate further includes a thread retention notch communicating with said needle aperture and extending downstream from said needle aperture, said notch cooperating with said looper blade to receive and stretch therebetween a strand of said secondary thread to retain said secondary thread loop across the path of said needle during downward movement of said needle and to confine said strand in said notch while said needle moves said primary thread through said secondary thread loop during downward movement of said needle, and wherein said throat plate further includes a spreader bar upstream of said needle for cooperation with said looper blade in forming said secondary loop by contacting and urging said secondary thread strand away from said needle path to assure adequate clearance for said needle to enter said secondary loop.

3. A two thread type bag closing sewing machine capable of stitching a bag closed as the bag moves in a downstream direction through said machine comprising:

a rigid housing including a feed dog chamber;

driving means carried by said housing;

primary and secondary thread sources adjacent said housing for supplying primary and secondary thread, respectively;

a needle driving assembly movably mounted to said housing, operatively connected with said driving means and including a reciprocating needle movable along a needle path into and out of said feed dog chamber, said needle including an eye, said eye carrying a loop of said primary thread;

a presser foot assembly adjacent said needle and carried by said housing to bear against the bag;

a feed dog assembly carried by said housing, operatively connected with said driving means and including a movable, reciprocating feed dog confronting the bag and cooperating with said presser foot assembly to advance the bag in said downstream direction past the reciprocating needle during stitching of the bag;

a throat plate adjacent said feed dog, said plate including a needle aperture communicating with said feed dog chamber and positioned along said needle path to receive said needle during stitching;

a looper assembly including a looper drive shaft having a central axis, movably mounted to said housing and operatively connected with said driving means for reciprocal swinging of said shaft through an arc about said shaft central axis and a looper unit fixed to said looper shaft and including a looper blade having a post with a post axis, said blade including an eye carrying a loop of such secondary thread, said looper blade being swingable closely adjacent said needle path in response to swinging of said looper shaft so the locus of said post axis defines a plane which is stationary relative to said needle path, so said blade hooks said loop of said primary thread and inserts said loop of secondary thread through said loop of primary thread;

said looper unit further including a looper block fixed to said looper shaft for rotation therewith and said post being retained by said block, said blade further including an elongated arm extending outwardly, cantileverly from said post and having said looper eye at the free end of said arm, said post and arm defining a hook at the intersection of said arm and post, and wherein said arm has an end adjacent said post and said arm further includes a thread slot extending from said eye to said end adjacent said post to receive and guide said secondary thread to said eye;

said feed dog assembly including a feed dog block having a section extending forwardly of said looper blade, said section having a tunnel passing through said section;

said secondary thread passing through said tunnel and extending from said tunnel rearwardly to said thread slot of said looper and along said slot to and through said looper eye;

thread guide means on said housing between said secondary thread source and said feed dog block to supply drag to said secondary thread to keep said secondary thread which extends between said tunnel and said thread slot biased against said slot to retain said secondary thread in said slot during operation; and wherein reciprocating movement of said feed dog while advancing the bag causes said tunnel to move relative to said guide means to aid in overcoming said drag and thereby assisting said looper blade in urging secondary thread from said secondary thread source.

4. A two thread looping process for stitching bags moving in a downstream direction through a two thread type bag closing sewing machine having a presser foot, a feed dog, primary and secondary threads and having moving means for manipulating loops of said secondary thread, said means consisting of a reciprocating needle having a needle eye through which a loop of primary thread is carried and which moves along a needle path and passes through the presser foot and a looper assembly having only one moving thread engaging unit consisting of a single looper unit consisting of a single swinging blade with a post having a post axis, a looper eye adjacent one end of the blade and carrying a loop of secondary thread, an angled hook on said single blade formed by the intersection of the post and the blade and spaced from the eye, and comprising the steps of:

moving the needle and the primary thread carried by the needle eye downward through the bag and the throat plate to insert the loop of primary thread below the throat plate;

swinging the blade of the looper and the carried loop of secondary thread toward the needle in a first upstream direction with the post axis moving along an arc lying substantially wholly within a plane and the blade moving from a first position clear of the needle path to a second position wherein the blade cooperates with and passes closely adjacent the needle and within the loop of primary thread carried by the needle to hook the primary thread loop from the needle and simultaneously inserts the carried loop of secondary thread within the primary thread loop while said needle is adjacent the blade to cause the loop of primary thread to slide in a direction opposite said first direction and against said hook;

moving the needle upward along the needle path to withdraw it from the throat plate and the bag;

moving the feed dog in the downstream direction past the needle to cooperate with the presser foot to advance the bag in the downstream direction for the next stitch;

moving the needle downward through the bag and along the needle path through the loop of secondary thread carried on said single blade to retain the secondary loop while the looper blade swings from second position toward first position with the post axis remaining wholly in the plane as the feed dog continues to move the bag downstream to thereby pull the primary thread loop tightly about the secondary loop; and moving the needle upward to a position clear of the bag and returning the looper blade to first position while the post axis remains wholly in the plane.

* * * * *